United States Patent [19]

Hirano et al.

[11] Patent Number: 4,554,951

[45] Date of Patent: Nov. 26, 1985

[54] METHOD OF REGULATING WARP YARN TENSION IN A WEAVING MACHINE

[75] Inventors: Hideo Hirano, Kariya; Masahiko Kimbara, Okazaki, both of Japan

[73] Assignee: Kabushiki Kaisha Toyoda Jidoshokki Seisakusho, Kariya, Japan

[21] Appl. No.: 550,752

[22] Filed: Nov. 10, 1983

[30] Foreign Application Priority Data

Nov. 16, 1982 [JP] Japan ..... 57-200794

[51] Int. Cl.[4] ..... D03D 49/06

[52] U.S. Cl. ..... 139/105; 139/110

[58] Field of Search ..... 139/105, 110, 109, 97, 139/99; 66/209, 210, 211, 212

[56] References Cited

U.S. PATENT DOCUMENTS

| | | | |
|---|---|---|---|
| 3,125,127 | 3/1964 | Locher | 139/97 |
| 3,753,451 | 8/1973 | Hosono et al. | 139/110 |
| 3,930,523 | 1/1976 | Garcia | 139/110 X |
| 4,122,873 | 10/1978 | Pfarrwaller et al. | 139/110 |

FOREIGN PATENT DOCUMENTS

| | | | |
|---|---|---|---|
| 2155852 | 5/1973 | France | 139/110 |

*Primary Examiner*—James Kee Chi

*Attorney, Agent, or Firm*—Brooks Haidt Haffner & Delahunty

[57] ABSTRACT

A method of regulating the tension of warp yarns in a weaving machine is disclosed herein. Displacement of a tension roller, which is movable with a change in warp yarn tension, from a reference position corresponding to an optimum tension of the warp yarns in the weaving machine is detected by a sensor, which then converts such mechanical displacement of the tension roller into electrical signals proportional to the amount of said displacement. The signals are sampled successively in synchronism with the operation of the weaving machine. Adjustment of the speed at which a warp beam is rotated is made depending upon the data from sampled signals in such a way that the speed is decreased when the tension is dropped beyond the lower limit of a predetermined range, while it is increased when the tension is built up to exceed the upper limit thereof. In addition, adjustment of the warp beam rotational speed is made such that the speed is increased when the tension is built up so rapidly within the range as to exceed a predetermined rate, while it is decreased when the tension is dropped so rapidly within the range as to exceed said rate.

10 Claims, 11 Drawing Figures

METHOD OF REGULATING WARP YARN TENSION IN A WEAVING MACHINE

BACKGROUND OF THE INVENTION

The present invention relates generally to a method of regulating the tension of warp yarns in a weaving machine. More specifically, it relates to a method of regulating the tension of warp yarns in a loom by controlling the feeding speed of the warp yarns from a warp beam in response to the displacement of a tension roller beyond a predetermined permissible range of warp tension or with a rapid rate of displacement thereof.

In a conventional method of regulating the warp yarns delivered from a warp beam in a weaving machine so as to maintain the tension thereof within the limits of a predetermined permissible range, the variation of the warp yarn tension is monitored constantly by a detecting member such as a tension roller movable with a change in the tension of the warps, and the speed at which the warp yarns are unwound from the warp beam is increased when the tension is built up to exceed the upper limit of the permissible range while the speed is decreased when the tension is dropped below the lower limit of the range, thus providing automatic regulation of warp yarn tension during the weaving operation of the loom.

A typical arrangement for controlling the warp yarn tension in a weaving machine or a loom is exemplified in FIG. 1. A tension roller 1 which is attached at one end of a tension lever 4 rotatable about a stationary shaft 30 is caused to move up and down in response to the change in tension of the warp yarns Y which are unwound from a warp beam 2 and passed over a back roller 3 and then over said tension roller 1. This motion of the tension roller 1 is transmitted to a speed change control lever 7 of a speed change device or a speed reducer 6 through a link 5 which is articulated at one end thereof to the other end of the tension lever 4 and at the opposite end thereof to said control lever 7. The reduction unit 6, which reduces the output speed of a main motor M of the loom and drives the warp beam 2 at a reduced speed, thus changes its speed change ratio or reduction ratio in accordance with the displacement of the tension roller 1. In FIG. 1, reference symbol W denotes a counterweight which acts to urge the tension lever 4 to rotate in clockwise direction (as viewed in FIG. 1) about the shaft 30 for providing a desired tension to the warp yarns Y; reference numeral 8 designates the shaft of the beam 2; reference numeral 9 designates a shed formed by upper and lower sheets of warps $Y_1$ and $Y_2$; and numeral 10 indicates a cloth roller which is driven by the main motor through a reduction unit (not shown) for winding up at a constant speed a woven fabric or cloth C guided by a guide roller 11.

In the above arrangement for regulating warp yarn tension, when the tension of the warp yarns Y is increased to exceed the upper limit of a predetermined permissible range, the tension roller 1 is moved downwards against the action of the counterweight W to lift the speed change control lever 7 slightly, thereby increasing the speed at which the warp yarns Y are fed out from the warp beam 2; while, in the event of a decrease in warp yarn tension below the lower limit of said range, the tension roller 1 is displaced upwards under the influence of the counterweight W to turn the lever 7 slightly downward, thereby decreasing the warp yarn feeding speed.

In the above structure for warp yarn tension controlling, however, since the control lever 7 of the speed reduction unit 6 should be turned upwards for progressively increasing the rotational speed of the warp beam 2 with a progressive decrease in the diameter of the warp yarn winding on the warp beams 2 so as to maintain a substantially constant feeding speed of the warp yarns Y irrespective of the change in said diameter, the tension roller 1 will be moved downwards gradually, accordingly. Consequently, the direction in which the tension of warp yarns Y acts on the tension roller 1 is varied with the downward movement of the latter with the result that the balance in tension between the upper and lower sheets of warp yarns $Y_1$, $Y_2$ will be changed, thus posing a disadvantage in that the handle or woven density of the resulting fabric C may be badly affected.

There is another disadvantage in the above conventional method of warp yarn regulation when restarting the loom from its standstill state after a machine stop due to failure in weft insertion through a shed, or for replacement of the warp beam 2 with a new one. In the standstill state the tension roller 1 is placed far from a position corresponding to an optimum tension of the warp yarns Y. That is, because adjustment of the speed change ratio of the speed reduction unit 6 is made whenever the warp tension is thrown out of its permissible range and the amount of such adjustment may be excessively large, it not only takes a long time before the tension roller 1 resumes a position within its specified range corresponding to the permissible range of warp yarn tension, but also the tension roller 1 itself may begin an oscillating motion without being restored within the range, thus posing a fear of producing cloth C with so-called weaving bar, which degrades the fabric quality.

Furthermore, in the conventional method of warp yarn regulation which relies only on the position of the tension roller, adjustment for the regulation is made only after the warp yarn tension is thrown out of its allowable range, which means that the response of the control to compensate for excessively high or low warp yarn tension is not quick enough.

SUMMARY OF THE INVENTION

In view of the above disadvantages and drawbacks of the prior method of warp yarn regulation in a weaving machine, an object of the present invention is to provide a novel method of warp yarn regulation in a loom according to which a preventive or forestalling control against excessively high or low warp yarn tension may be accomplished.

Another object of the invention is to provide a method of warp yarn regulation which stabilizes the warp tension variation and permits a high standard of response and accuracy in controlling warp yarn tension within a permissible range thereof.

The above objects are attained by converting the mechanical displacement of a tension roller movable with the change in warp yarn tension into successive electrical voltages and controlling the speed at which the warp beam is rotated for unwinding of the warp yarns in accordance with the magnitude of an output voltage, or with the rate at which an output voltage is increased or decreased with respect to another output voltage which precedes the increasing or decreasing voltage for a given length of time and is in synchronism with the loom operation.

The above and other objects and advantages of the present invention will become more readily apparent to those skilled in the art from the following detailed description of a preferred embodiment according thereto, taken in conjunction with the accompanying drawings, wherein:

BRIEF DESCRIPTION OF THE DRAWINGS

FIG. 4(*b*) is a diagram showing a state in which a pilot motor used in the arrangement of FIG. 2 is operated in its reverse direction in the event of the situation of FIG. 4(*a*);

FIG. 5(*b*) is a diagram showing a state in which the pilot motor is operated in its forward direction in the event of the situation of FIG. 5(*a*);

FIG. 6(*b*) is a diagram showing a state in which the pilot motor is operated in its reverse direction in the event of the situation of FIG. 6(*a*);

FIG. 7(*b*) is a diagram showing a state in which the pilot motor is operated in its forward direction in the event of the situation of FIG. 7(*a*).

DETAILED DESCRIPTION OF PREFERRED EMBODIMENT

A preferred embodiment of the warp yarn regulating method in a weaving machine according to the present invention will now be explained with reference to FIGS. 2 to 7.

Figure 2:
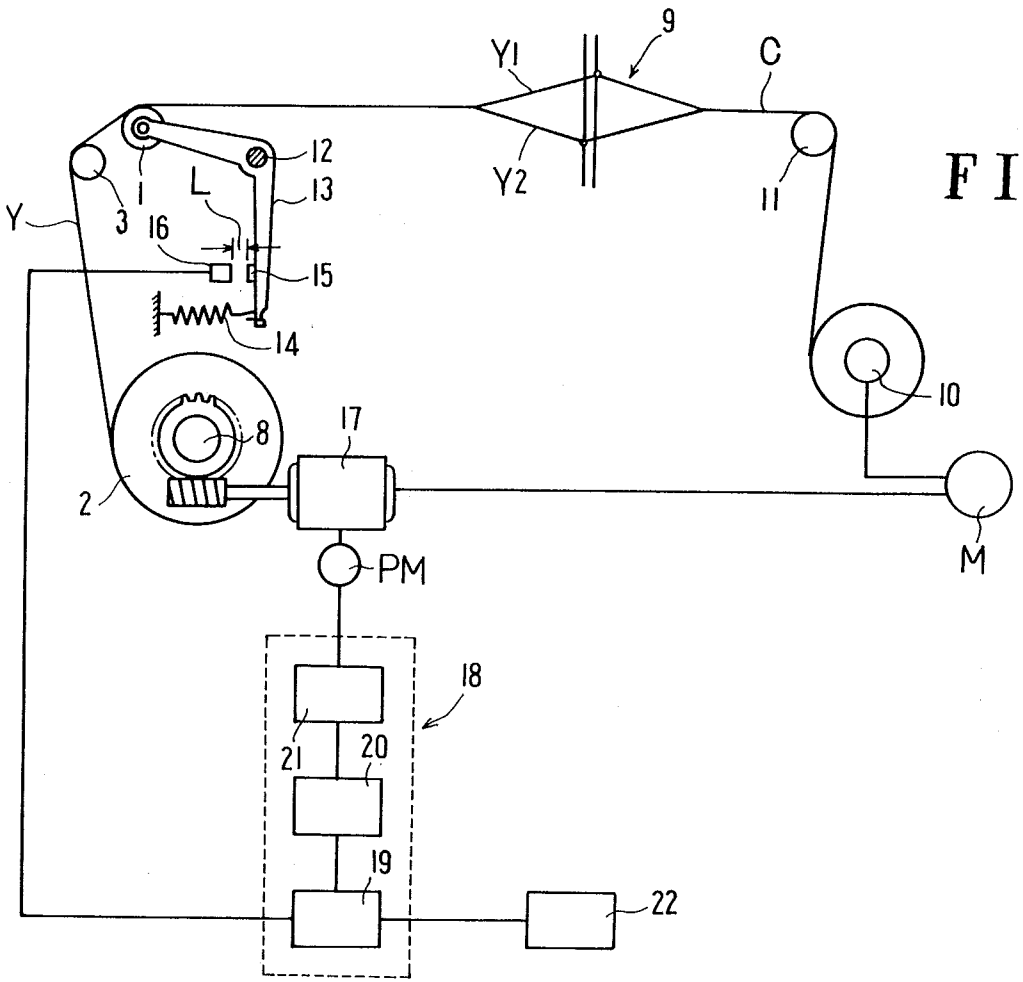
FIG. 2 is a schematic side view showing an arrangement of a weaving machine in which an embodiment of the present invention may be practiced.

Referring first to FIG. 2, warp yarns Y unwound and delivered from a warp beam 2 are passed over a back roller 3 and then a tension roller 1 to shedding area 9 defined by upper and lower sheets of warp yarns $Y_1$, $Y_2$, where they are woven with weft yarns (not shown) into a fabric or cloth C, which is then transferred over a guide roller 11 and wound up at a substantially constant take-up speed onto a cloth roller 10 which is driven by the loom's main motor M through a speed reduction unit (not shown).

The tension roller 1 is rotatably supported at an end of a detecting lever 13 of an inverted L-shape which is supported rotatably on a stationary shaft 12 and urged in a direction to cause the lever 13 to rotate clockwise as viewed in FIG. 2 under the influence of a spring 14 attached at the other end of the lever 13 so that the tension roller 1 is held constantly in pressing contact with the warp yarns Y at a position downstream of the back roller 3.

There is provided a magnet 15 fixed on said other end of the detecting lever 13 at a position adjacent to the spring 14. A stationary magnetically-operated sensor 16 is spaced from, and disposed opposite to said magnet 15 with a variable distance L therebetween. The distance L varies according to the movement of the tension roller 1 caused by a change in warp yarn tension. That is, when an increase in tension of warp yarns Y takes place, the tension roller 1 is pressed downwards to rotate the detecting lever 13 in counterclockwise direction as viewed in FIG. 2 on the shaft 12, so that the spacing distance L between the stationary sensor 16 and the magnet 15 movable with the lever 13 is enlarged; while a decrease in warp yarn tension allows the tension roller 1 to move upwards under the influence of the spring 14 and the detecting lever 13 is turned, therefore, in clockwise direction so that the gap distance L is narrowed. The magnetic sensor 16 is so constructed that it converts the mechanical movement of the tension roller 1 into electrical signals or voltages V by responding to the varying distance L between the stationary sensor 16 and the movable magnet 15. Such output voltages V are supplied to a control device 18 which is to be described in a later part hereof.

Figure 3:
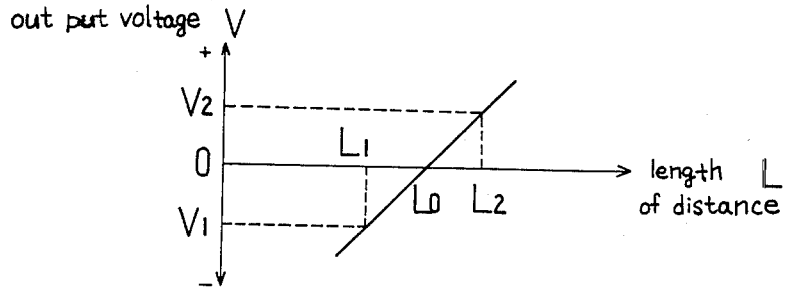
FIG. 3 is a diagram illustrating the relationship between the displacement of a tension roller used in the arrangement of FIG. 2 and an electrical signal or voltage converted therefrom.

The sensor 16 converts the mechanical movement of the tension roller 1, or the varying spacing distance L, linearly into output voltages V as shown diagrammatically in FIG. 3, wherein the distance $L_0$ corresponds to an optimum or reference warp yarn tension $T_0$ where no voltage is produced by the sensor 16, and $L_1$ and $V_1$ correspond to the lower limit of a permissible range $T_1$–$T_2$ of warp tension, and $L_2$ and $V_2$ to the upper limit of said range. As is apparent from the foregoing and also from FIG. 3, the relationship among the values for each letter symbol is such that $T_1<T_0<T_2$, $L_1<L_0<L_2$ and $V_1<0<V_2$.

A speed change device or a speed reducer 17, which reduces the output speed from the main motor M for driving the warp beam 2 at a reduced speed desired for unwinding the warp yarns Y therefrom, is equipped with a reversible pilot motor PM which controls the reduction ratio of the speed reducer unit 17 by rotating it in either forward or reverse direction in accordance with a control signal from the control device 18. That is, when the pilot motor PM is operated forward, the output speed of the reduction unit 17 is slowed down; when the pilot motor is reversed, the output speed is increased.

The control device 18 includes, in the sequence of control, a data sampling circuit 19, a sampling data storage circuit 20 and a control circuit 21 which performs the functions of computation of input data, comparison thereof and generation of a control signal to the pilot motor PM. The data sampling circuit 19 samples or picks up output voltages V from the magnetic sensor 16 one at a time. To be more specific, the circuit 19 samples one output voltage V at a specific crank angle of the loom in each operational cycle thereof in response to a signal transmitted by a sensor 22 which is adapted to provide such a signal to the data sampling circuit 19 when it detects said specific crank angle of the loom in operation. This sampling of data is performed for the sake of stability and accuracy in detecting the operation of the tension roller 1, in view of the fact that a momentary change in warp yarn tension occurs, and is caused by the beating-up or shedding motion, during any one operating cycle of the loom.

Such data of successive voltages sampled by the sampling circuit 19 are supplied to the subsequent data storage circuit 20, where they are stored temporarily. Simultaneously, the data are supplied also to the control circuit 21, which transmits a control signal to the pilot motor PM, as required, depending on the data from the storage circuit 20.

The control circuit 21 in the control device 18 operates in a manner as will now be described for regulating the warp yarn tension in the arrangement described with reference to FIGS. 2 and 3.

As shown in FIG. 3, the magnitude of the sensed voltage V is proportional to the spacing distance L between the sensor 16 and magnet 15 (FIG. 2) which, in turn, is proportional to the magnitude of displacement of the tension roller 1 from its ideal, or reference position represented by $L_0$ and $V_0$. Thus, the magnitude of the sensed voltage V is directly proportional to the tension T in the warp yarns Y.

Figure 4A:
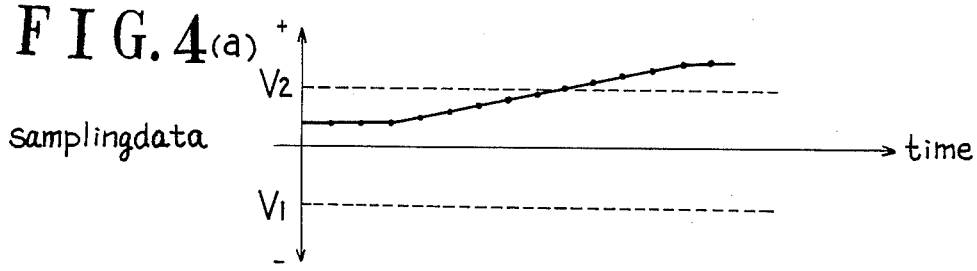
FIG. 4(*a*) is a diagram showing sampling data of voltage plotted with an increase of warp yarn tension beyond the upper limit of a permissible range thereof.
Figure 4B:
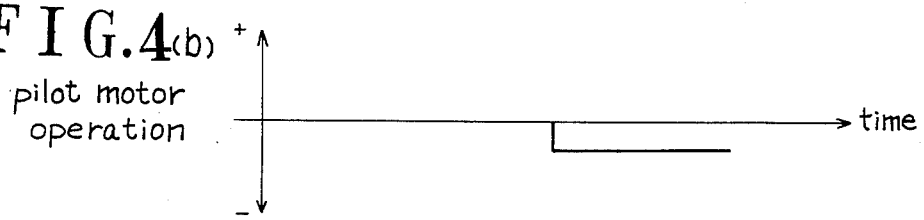

When a voltage sampled by the data sampling circuit 19 in the manner previously described (such voltage is plotted and indicated by a dot in FIG. 4(*a*) and also in other similar drawings that follow, and is referred to hereinafter as a sampling voltage) exceeds the upper limit $V_2$ of the range $V_2$–$V_1$, as shown in FIG. 4(*a*), due to an increase of the warp yarn tension beyond its upper limit $T_2$ of the permissible range $T_2$–$T_1$, the control circuit 21 in response thereto provides a control signal which causes the pilot motor PM to rotate in its reverse direction as indicated in FIG. 4(*b*). Accordingly, the reduction ratio of the speed reduction unit 17 is varied so as to speed up the rotation of the warp beam shaft 8 for increasing the rate at which the warp yarns Y are unwound and delivered from the warp beam 2, so that compensation is made in such a way that the warp yarn tension beyond its upper limit $T_2$ is restored within the permissible range $T_2$–$T_1$.

Figure 5A:
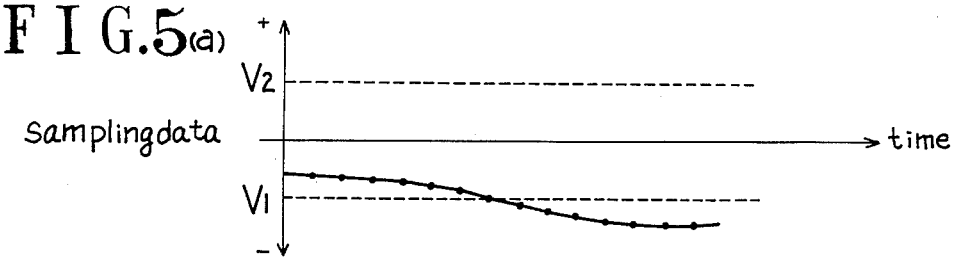
FIG. 5(*a*) is a diagram showing sampling data of voltage plotted with a decrease of warp yarn tension beyond the lower limit of the permissible range.
Figure 5B:
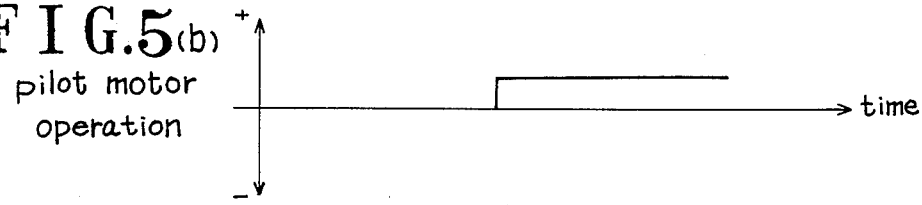

On the other hand, when a sampling voltage is below the lower limit $V_1$ of the range $V_2$–$V_1$ as shown in FIG. 5(*a*) due to a drop in warp yarn tension beyond its lower limit $T_1$ of the permissible range $T_2$–$T_1$, the control circuit 21 then transmits a control signal which causes the pilot motor PM to operate in its forward direction as indicated in FIG. 5(*b*). The result is that the reduction ratio of the speed reduction unit 17 is varied so as to slow down the rotation of the warp beam shaft 8 for decreasing the rate at which the warp yarns Y are unwound from the warp beam 2 and compensation is made, therefore, in such a way that the warp yarn tension beyond its lower limit $T_1$ is restored within the permissible range $T_2$–$T_1$.

There is a fear, unlike the gradual change in warp yarn tension as in the above-mentioned cases, that the tension of warp yarns Y may show a very rapid increase or decrease suddenly for any reason within the permissible range $T_2$–$T_1$ thereby to allow the tension to go too far beyond the upper or lower limit of the range for proper control. In view of such possible change in warp tension, the control circuit is so arranged that it actuates the pilot motor PM in response to such a rapid change before the warp yarn tension is thrown out of the permissible range $T_2$–$T_1$, as detailed below.

Figure 6A:
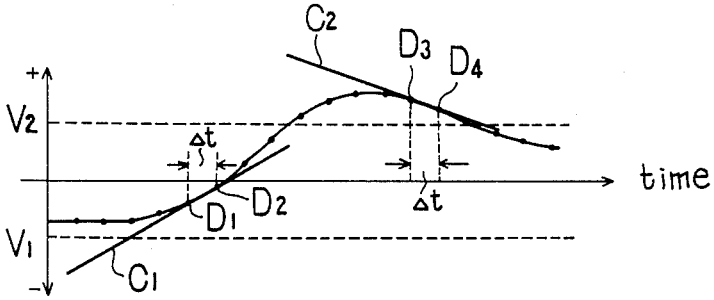
FIG. 6(*a*) is a diagram showing sampling data of voltage plotted with a rapid increase of warp yarn tension beyond the upper limit of the permissible range and the subsequent restoration thereof into the range.
Figure 6B:
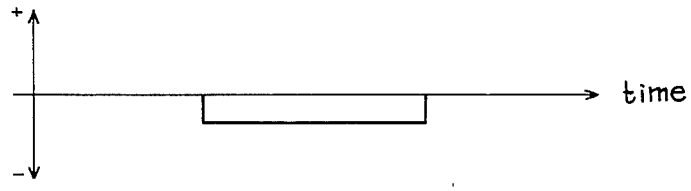

In FIG. 6(*a*), there is seen a very sharp increase of sampling voltage between two adjacent plotted points $D_1$ and $D_2$ due to a rapid build-up of warp yarn tension. When the tension is increased at such a rapid rate that the ratio of the difference between the sampling voltage at a point, e.g. at $D_2$, and that at the point that just precedes, e.g. at $D_1$, to a given length of time $\Delta t$ which is spent for one complete operating cycle of the loom, the degree of said ratio being represented by a straight line $C_1$ inclined at an angle with respect to the horizontal, becomes greater than a predetermined reference value $v_1$ for comparison, the control circuit 21 provides a control signal to initiate the pilot motor PM to be operated in its reverse direction for increasing the rotational speed of the warp beam shaft 8. It should be noted in the above description that said difference of the sampling voltage at $D_2$ from that at $D_1$ and said reference value $V_1$ are positive or greater than 0. With the pilot motor PM thus operated reversely as indicated in FIG. 6(*b*), the speed reduction ratio of the reduction unit 17 is adjusted to cause the warp beam shaft 8 to speed up its rotation. Accordingly, the speed at which the warp yarns Y are delivered from the warp beam 2 is increased so as to restore the warp yarn tension toward the optimum state $T_0$.

If the angle of inclination of a straight line containing any two adjacent points of sampling voltage, or a line similar to $C_1$, becomes smaller than a predetermined value corresponding to said reference value $V_1$ within the permissible range $T_2$–$T_1$ (or $V_2$–$V_1$); or, in other words, if the rate at which the warp yarn tension increases is decelerated within said permissible range to such an extent that the ratio of the difference in sampling voltage between said two adjacent points to the time $\Delta t$ becomes smaller than $V_1$, the control circuit 21 stops providing the control signal and, therefore, the pilot motor PM stops its reversing operation. If the warp yarn tension exceeds the upper limit $V_2$ of the range $V_2$–$V_1$ as shown in FIG. 6(*a*) with the angle of inclination of a straight line containing any two adjacent plotted points of sampling voltage within the permissible range $V_2$–$V_1$ remaining greater than $V_1$, however, the control circuit 21 keeps its control signal effective in order to allow the pilot motor PM to continue to run in reverse direction.

When the warp yarn tension is decreased, due to the compensating effect of the pilot motor PM from its peak while outside the permissible range $T_2$–$T_1$ (or $V_2$–$V_1$), as shown in FIG. 6(*a*), at such a rate that the ratio of the difference between the sampling voltage at a point, e.g. at $D_4$, and that at a preceding point, e.g. at $D_3$, to the given length of time $\Delta t$, the degree of said ratio being represented by a straight line $C_2$ inclined at an angle with respect to the horizontal, becomes smaller than a predetermined reference value $V_2$ for comparison, the control circuit 21 nullifies its reversing control signal and therefore the pilot motor PM stops its reversing rotation. It should be noted in the above description that said difference of the sampling voltage at $D_4$ from that at $D_3$ and said reference value $D_2$ are negative or smaller than 0. Even if the pilot motor operation is stopped while the tension is still beyond the upper limit $T_2$ (or $V_2$), it can be safely anticipated that the tension will be restored to within the permissible range $T_2$–$T_1$ (or $V_2$–$V_1$) with no further adjustment of the reduction ratio of the speed reduction unit 17 since the angle of the inclined straight line $C_2$ is smaller than a value corresponding to said reference value $V_2$. Furthermore, by so stopping the pilot motor PM, the fear of allowing the warp yarn tension to go further than the opposite lower limit $T_1$ of the range $T_2$–$T_1$ by inertia may be forestalled successfully.

Figure 7A:
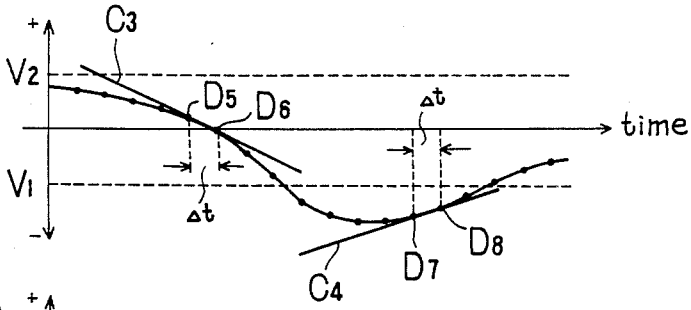
FIG. 7(*a*) is a diagram showing sampling data of voltage plotted with a rapid decrease of warp yarn tension beyond the lower limit of the permissible range and the subsequent restoration thereof into the range.
Figure 7B:
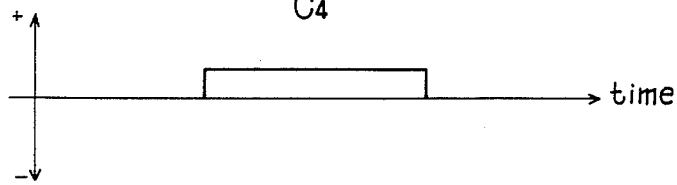

Referring then to FIG. 7(*a*), there is seen a very sharp decrease of sampling voltage between two adjacent plotted points $D_5$ and $D_6$ due to a rapid drop in warp yarn tension. When the tension is decreased at such a rapid rate that the ratio of the difference between the sampling voltage at a point, e.g. at $D_6$, from that at the preceding point, e.g. at $D_5$, to the aforementioned length of time $\Delta t$, the degree of said ratio being represented by a straight line $C_3$ inclined at an angle with respect to the horizontal, becomes smaller than a predetermined reference value $-V_1$ for comparison, the control circuit 21 provides a control signal to initiate the pilot motor PM to be operated in its forward direction for decreasing the rotational speed of the warp beam shaft 8. With the pilot motor PM thus operated forwardly as indicated in FIG. 7(*b*), the speed reduction ratio of the reduction unit 17 is adjusted so as to cause the warp beam shaft 8 to slow down its rotation. Accordingly, the speed at which the warp yarns Y are delivered from the warp beam 2 is decreased so as to restore the warp yarn tension toward the optimum state $T_0$.

If the angle of inclination of a straight line containing any two adjacent points of sampling voltage, or a line similar to $C_3$, becomes greater than a predetermined value corresponding to said reference value $-V_1$ within the permissible range $T_2$–$T_1$ (or $V_2$–$V_1$); or, in other words, if the rate at which the warp yarn tension decreases is slowed down within said permissible range to such an extent that the ratio of the difference in sampling voltage between said two adjacent points to the time $\Delta t$ becomes greater than $-V_1$, the control circuit 21 stops providing the control signal and, therefore, the pilot motor PM stops its forward rotation. If the warp yarn tension goes beyond the lower limit $V_1$ of the range $V_1$–$V_2$ as shown in FIG. 7(*a*) with the angle of inclination of a straight line containing any two adjacent plotted points of sampling voltage within the permissible range $V_1$–$V_2$ remaining smaller than $-V_1$, however, the control circuit 21 keeps its control signal effective in order to allow the pilot motor PM to continue to run in forward direction.

When the warp yarn tension is increased due to the compensating effect by the pilot motor PM from a tension valve below the permissible range $T_2$–$T_1$ (or $V_2$–$V_1$), as shown in FIG. 7(*a*), at such a rate that the ratio of the difference between the sampling voltage at a point, e.g. at $D_8$, and that at the preceding point, e.g. at $D_7$, to the length of time $\Delta t$, the degree of said ratio being represented by a straight line $C_4$ inclined at an angle with respect to the horizontal, becomes greater than a predetermined reference value $-V_2$ for comparison, the control circuit 21 nullifies its forwarding control signal and therefore the pilot motor PM stops its forward rotation. Even if the pilot motor operation is stopped while the tension is still beyond the lower limit $T_1$ (or $V_1$), it can be safely anticipated that the tension will be restored to within the permissible range $T_2$–$T_1$ (or $V_2$–$V_1$) with no further adjustment of the reduction ratio of the speed reduction unit 17 since the angle of the inclined straight line $C_4$ is greater than a value corresponding to said reference value $-V_2$. Furthermore, by so stopping the pilot motor PM, the fear of allowing the warp yarn tension to go beyond the opposite upper limit $T_2$ of the range $T_2$–$T_1$ by inertia may be forestalled successfully.

As is now apparent from the foregoing, unlike a conventional method which cannot cope with a rapid change in warp yarn tension within a permissible range because controlling of the tension is effected only after it goes beyond either of the upper or lower limits of the range, according to the embodiment of the present invention wherein an electrical voltage is generated by the displacement of a movable tension roller 1 from its reference position $L_0$ corresponding to a reference or optimum warp tension $T_0$, a voltage sample being taken for each operating cycle of the weaving machine, the warp yarn tension is regulated depending upon the ratio of the difference between any two succeeding sampled voltages to a given length of time $\Delta t$. Controlling of the tension can be achieved even during a rapid change thereof within the permissible range, whereby throwing the warp yarn tension far beyond either of the limits is prevented successfully.

Furthermore, unlike the conventional method in which a long time may be spent before the speed reduction ratio is restored to a normal state, or before the warp yarn resumes its normal tension, due to an excessively large amount of adjustment of the speed reduction mechanism (because adjustment for varying the speed reduction ratio of the mechanism is made in either direction as long as the warp yarn tension stays outside the permissible range thereof), the embodiment of the invention wherein the adjustment of the speed reduction ratio is stopped as required outside the permissible range, can permit the warp tension to be restored quickly to within the range without allowing the tension to be thrown out of the opposite limit thereof. Even when the tension roller is displaced far from its reference position corresponding to an optimum tension due to a stopping of the machine operation consequent to a failure in weft yarn insertion or for the reason of warp beam replacement, the use of the method of the invention makes it possible for the warp yarn tension to be restored quickly to within the specified permissible range without causing a fluctuating variation of the tension, thus offering an advantage in that formation of harmful weaving bars may be prevented. In this way, the method according to the present invention, which provides preventive control against variation in warp yarn tension, can stabilize the manner in which the variation takes place with a high standard of accuracy and quick response in controlling for regulation of warp yarns.

Figure 1:
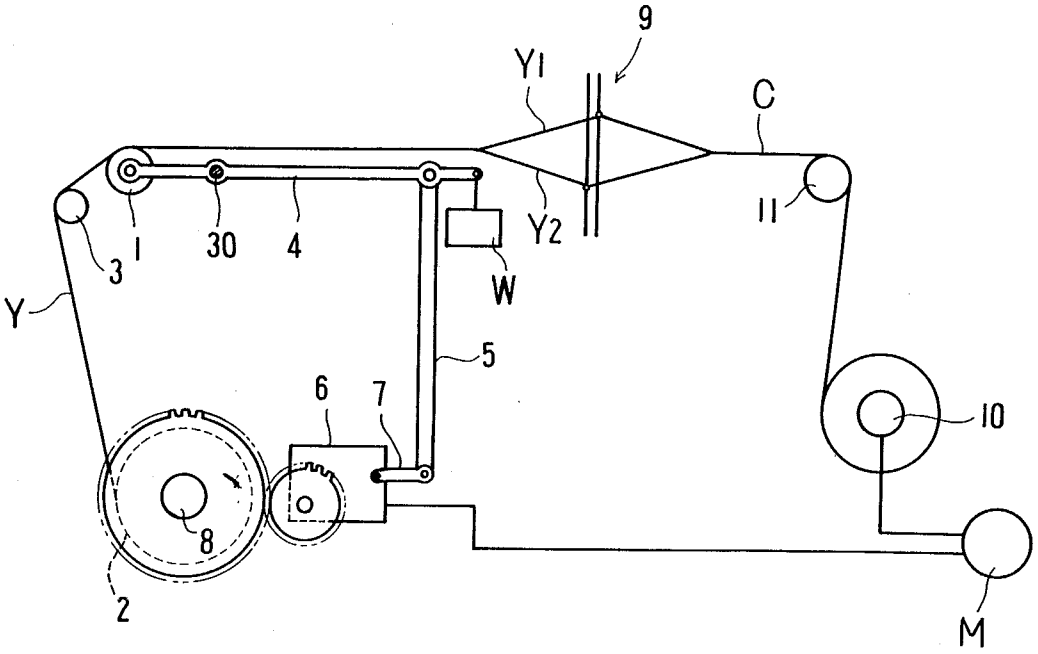
FIG. 1 PRIOR ART
FIG. 1 is a schematic side view showing an example of a conventional method of regulating the warp yarn tension in a weaving machine.

Furthermore, unlike the conventional method as exemplified in FIG. 1 wherein the position of the tension roller is varied progressively in accordance with the reduction of the diameter of the warp yarn winding on the warp beam, thereby influencing the balance of tension between the upper and lower sheets of warps and resulting in poor handle or change in weaving density in the woven fabrics, the tension roller used in practicing the method of the invention is not influenced by the change of diameter of the warp winding, thus making possible the production of fabrics with the desired level of quality without defects such as poor handle or change in weaving density.

While the invention has been illustrated and described with reference to a preferred embodiment thereof, it is to be understood that various changes in the details may be made without departing from the spirit and scope of the invention.

For example, instead of sampling an output voltage from the sensor for each operating cycle of the loom as in the described preferred embodiment, a mean value from a plurality of voltages sampled in one rotation of the loom may be used as the sampling data for comparison with the associated reference value. In another embodiment of the invention, a mean value from a plurality of sampling voltages for said plurality of rotations of the loom may be used for the same purpose. Furthermore, the data may be sampled continuously other than during the beating-up and shedding phases in loom operation. The pilot motor PM may be so arranged that it varies its rotational speed in proportion to the distance of displacement of the tension roller from its reference position. The afore-mentioned magnetic sensor 16 may be replaced by any other convenient means such as as a differential transformer.

What is claimed is:

1. A method for regulating the tension of warp yarns with reference to a predetermined permissible range thereof spanning a reference point corresponding to an optimum tension of said warp yarns, in a weaving machine which includes a means for tensioning said warp yarns delivered from a warp beam, said tensioning means being movable with a change in tension of said warp yarns in contact therewith, and a means for driving said warp beam at variable speed, said method comprising the steps of:

converting the mechanical movement of said tensioning means into an electrical signal which is proportional to the magnitude of displacement of said tensioning means from a position thereof corresponding to said reference point;

sampling said electrical signals successively in synchronism with the operation of the weaving machine to determine successive instantaneous magnitudes of displacement of said tensioning means from its said reference point position;

comparing the difference between successive ones of said electrical signal samples with the time difference between the sampling of said successive ones of said samples, to determine a rate of change of said displacement of said tensioning means from said reference point position; and varying the speed of said warp beam driving means depending upon the magnitude of said displacement and said rate of change of said displacement of said tensioning means to change the tension in said warp yarns in a compensating manner, whereby said tensioning means moves towards its said reference point position.

2. A method according to claim 1, wherein one said sampling is performed for each operating cycle of the weaving machine.

3. A method according to claim 1, wherein said speed of said warp beam driving means is increased when said rate of change of displacement is greater than a predetermined permissible rate, and maintained constant when said rate of displacement is less than said predetermined permissible rate.

4. A method according to claim 3, wherein said speed of said warp beam driving means is decreased when said rate of change of displacement is less than a second predetermined permissible rate, and maintained constant when said rate of displacement is greater than said second predetermined permissible rate, whereby said tension of warp yarns is maintained substantially within said predetermined permissible range thereof.

5. A method according to claim 1, wherein said varying of the speed of said warp beam driving means is effected only in response to a magnitude of said displacement of said tensioning means corresponding to a warp yarn tension which is outside said permissible range thereof.

6. A method according to claim 1, wherein said varying of the speed of said warp beam driving means is effected when said magnitude of said displacement of said tensioning means corresponds to a warp yarn tension which is within said permissible range thereof and said rate of change of said displacement of said tensioning means is greater or less than a predetermined permissible rate of change thereof.

7. A method according to claim 1, wherein said varying of the speed of said warp beam driving means is discontinued while said magnitude of said displacement of said tensioning means corresponds to a warp yarn tension which is outside said permissible range thereof but said rate of change of said displacement of said tensioning means substantially equals a predetermined permissible rate of change thereof.

8. A method according to claim 1, wherein said means for driving said warp beam at variable speed includes a speed reducing device between said warp beam and a main motor of said weaving machine, said speed reducing device having a speed reduction ratio which is variable responsive to actuation of a reversible pilot motor, and said varying of the speed of said warp beam driving means comprises actuating said pilot motor.

9. A method according to claim 8, wherein the speed of said pilot motor is variable, and said method comprises varying the speed of said pilot motor in direct proportion to said magnitude of displacement of said tensioning means from its said reference point position.

10. A method according to claim 1, wherein said sampling comprises first determining a mean value of a plurality of said successive samples of electrical signals taken during each of two successive operating cycles of said weaving machine, and said comparing comprises comparing the difference between said successive mean values of said electric signal samples with the time of one said operating cycle.

* * * * *

UNITED STATES PATENT AND TRADEMARK OFFICE

CERTIFICATE OF CORRECTION

PATENT NO. : 4,554,951

DATED : November 26, 1985

INVENTOR(S) : HIRANO ET AL.

It is certified that error appears in the above-identified patent and that said Letters Patent is hereby corrected as shown below:

Column 2, line 8, "beams" should be --beam--.

Column 5, lines 62 and 63, "warp tension" should be --warp yarn tension--.

Column 6, line 16, "$V_1$" should be --$v_1$--.

Column 6, line 27, "$V_1$" should be --$v_1$--.

Column 6, line 33, "$V_1$" should be --$v_1$--.

Column 6, line 40, "$V_1$" should be --$v_1$--.

Column 6, line 45, a comma should be inserted after PM.

Column 6, line 53, "$V_2$" should be --$v_2$--.

Column 6, line 58, "$D_2$" should be --$v_2$--.

Column 6, line 66, "$V_2$" should be --$v_2$--.

Column 7, line 13, "__$V_1$" should be -- -$v_1$ --.

UNITED STATES PATENT AND TRADEMARK OFFICE

CERTIFICATE OF CORRECTION

PATENT NO. : 4,554,951

DATED : November 26, 1985

INVENTOR(S) : HIRANO ET AL.

It is certified that error appears in the above-identified patent and that said Letters Patent is hereby corrected as shown below:

Column 7, line 28, "__$V_1$" should be -- -$v_1$ --.

Column 7, line 34, "__$V_1$" should be -- -$v_1$ --.

Column 7, line 41, "__$V_1$" should be -- -$v_1$ --.

Column 7, line 54, "__$V_2$" should be -- -$v_2$ --.

Column 7, line 64, "__$V_2$" should be -- -$v_2$ --.

Signed and Sealed this

*Eighteenth* Day of *March 1986*

[SEAL]

*Attest:*

DONALD J. QUIGG

*Attesting Officer*

*Commissioner of Patents and Trademarks*